United States Patent [19]

Dalle et al.

[11] 4,011,043

[45] Mar. 8, 1977

[54] LIQUID AMMONIA DYEING PROCESS

[75] Inventors: Jean-Paul Dalle; Maryvonne Vaesken, both of Saint Quentin, France

[73] Assignees: Opidryochimie, Grugies; Alain Declercq; Philippe Declercq, both of Hem, all of France

[22] Filed: May 29, 1975

[21] Appl. No.: 581,795

[30] Foreign Application Priority Data

June 6, 1974 France ..... 74.19661

[52] U.S. Cl. ..... 8/54; 8/174; 8/85 B; 8/82

[51] Int. Cl.[2] ..... D06P 3/14; D06P 1/673

[58] Field of Search ..... 8/82, 85 A, 174, 54

[56] References Cited

UNITED STATES PATENTS

| | | | |
|---|---|---|---|
| 1,998,551 | 4/1935 | Mahan | 8/85 A |
| 3,666,398 | 5/1972 | Tratynek | 8/82 |
| 3,885,587 | 5/1975 | Troope | 8/85 A |
| 3,892,521 | 7/1975 | Dalle | 8/82 |

*Primary Examiner*—Donald Levy

*Attorney, Agent, or Firm*—Lewis H. Eslinger

[57] ABSTRACT

This invention relates to a process of dyeing natural or synthetic polyamidic textile materials, textile materials composed of polyacrylic polymers, textile materials composed of polyester and textile materials composed of chlorinated hydrocarbons, in which the material is subjected to the action of the liquid ammonia, then the dyeing operation is carried out by any process on the ammonia-impregnated material.

9 Claims, No Drawings

LIQUID AMMONIA DYEING PROCESS

The present invention relates to a process for dyeing textile materials in which these materials are subjected to a pre-treatment with liquid ammonia.

In the treatment of textile materials, numerous processes are known in which it is sought to fix on this material an element brought by another medium in which it is generally dissolved. A typical example of such treatments is dyeing, in which it is sought to fix a dye on the material; the use of finishings, various addition or filling products are also of the same type.

In a dyeing system, for example, in which it is desired to fix a dye dissolved in a solvent, the following phases are observed:

absorption of the solvent
adsorption of the dye
diffusion of the dye
fixing of the dye.

These different phases may be regulated by several parameters, in particular by the choice and conditions of use of the solvent. This solvent in fact acts two very distinct roles. On the one hand, it enables the material to swell and on the other hand enables the dye to be maintained in solution or possibly in suspension. The important characteristics of the solvent are as follows:

high vapor pressure promoting the absorption phase;
correct miscibility with water when the dye bath is an aqueous medium
low retention of the dye
low cost.

Different solvents which appear to be more advantageous than water, such as chlorinated solvents, alcohols, . . . have been proposed. It has also been proposed to use liquid ammonia, but the conditions of application required, in particular the use of high pressure or maintenance of the temperature below −33° C (boiling point of ammonia at atmospheric pressure) considerably restrict its use.

It is noted in French Pat. No. 72 17922 of 18th May 1972 that the fact of carrying out the dyeing operation of a cellulosic material on the product still impregnated with liquid ammonia substantially improved the dye affinity, whilst reducing the length of the dyeing operation. The treatment of natural or regenerated cellulosic materials by liquid ammonia has been known for a long time and it is known to improve certain of their properties, such as elongation strength, dimensional stability, gloss. The interest in using this dyeing process is therefore seen, which on the one hand uses, as pretreatment, a treatment already used and which, on the other hand, simplifies the ammonia-removal stage.

The idea was conceived of applying a process of this type, i.e. pre-treatment with liquid ammonia then dyeing, to the other types of fibers. It was quite unexpectedly discovered that interesting results were obtained even on materials on which liquid ammonia is reputed not to have beneficial action.

It is therefore an object of the present invention to provide a process of dyeing textile materials chosen from natural or synthetic polyamidic materials, polyacrylic polymers, polyesters, chlorinated hydrocarbons, pure or blended, in which the material is subjected to the action of the liquid ammonia, then the dye operation is effected by any process on the material still impregnated with ammonia. A partial drying or even a partial rinsing of the material between the pre-treatment with liquid ammonia and the drying may be carried out. It is even possible to eliminate the ammonia in liquid form completely if the material is left in an atmosphere of gaseous ammonia. In this case, operation is carried out in a closed apparatus. According to the desired results, any useful additive may be added to the liquid ammonia with which the pre-treatment is effected.

The invention will be more readily understood on reading the following description.

The material to be dyed is impregnated with liquid ammonia, pure or containing any useful additive; all the conventional processes may be used, such as passage of the material in a bath of liquid ammonia or use of a conventional dyeing apparatus of the autoclave type in which the ammonia is introduced then removed. The duration of this pre-treatment with liquid ammonia varies according to the material to be treated. In fact, for the materials on which the ammonia has no particular action or could even be detrimental, this duration will be short, just sufficient to ensure the thorough impregnation of the material, as will be explained hereinafter. When, on the contrary, an action of the ammonia on the material is sought after, e.g. when wool is treated, the duration of the pre-treatment will be adapted to the characteristics sought after for the product. An intermediate treatment time may also have to be defined in the case of mixtures.

In the most simple embodiment of the invention, the dyeing operation is then effected on the product still impregnated with liquid ammonia, according to any conventional process. It is ascertained that dye yields are then obtained which are much higher than the usual results. In order to be able to recycle part of the liquid ammonia and avoid a considerable pollution of the dye bath, the product is preferably dried between the pre-treatment and the dyeing. This partial removal of liquid ammonia may also be effected by a rapid rinsing.

It is obvious that the liquid ammonia evaporates very easily in ambient air. In order to avoid this evaporation, the liquid-ammonia-saturated product may be maintained in an atmosphere of gaseous ammonia between the pre-treatment and dyeing. Drying may also be effected in such an atmosphere. It was unexpectedly discovered that by maintaining the product in an atmosphere of gaseous ammonia until its impregnation by the dye bath, satisfactory results were obtained even by eliminating practically all the ammonia contained in liquid form in the product and by applying the dyeing operation to the product no longer impregnated with liquid ammonia but with gaseous ammonia. This maintaining under gaseous ammonia atmosphere is easily effected since the dyeing is often effected in closed apparatus. It is therefore sufficient to choose a closed dyeing autoclave in which the material to be treated is introduced, and to empty it of this ammonia after a period of time chosen as a function of the type of material and the desired result. The enclosure being closed, the material is thus maintained under a gaseous ammonia atmosphere. By making a depression, a partial drying is effected, then possibly a complete evaporation of the liquid ammonia. The dye bath is then introduced into the enclosure.

The liquid ammonia in fact acts one of the roles generally attributed to the solvent in which the dye is dissolved: it ensures the swelling of the material before its contact with the dye bath and facilitates the phase of absorption of the solvent. The phase of adsorption of the dye is then practically instantaneous, this causing a rapid and very thorough action of the dye. This process therefore enables either equivalent results for a shorter treatment time, or better results for an identical treatment time, to be obtained, with respect to a conventional dyeing process without pre-treatment with ammonia.

The action of the pre-treatment with liquid ammonia may also be envisaged to be due:

to the evaporation of the liquid ammonia when the matter enters a bath of hot solvent (temperature higher than −33° C), which considerably favors the exchanges;

to the solubility in the solvent of the gaseous ammonia either contained in the material or due to the evaporation of the liquid ammonia, this giving an effect of impregnation under reduced pressure, to the total miscibility of the ammonia and water which allows a replacement of one by the other when water is used as dye solvent.

to the rupture of the material-ammonia links, which leaves the material in a particularly reactive state vis-a-vis the water and the dyes.

In certain cases, it may be necessary to neutralize the ammonia formed by acidifying the dye bath. In fact, by varying the temperature, the pH of the bath, and the concentration of dye, the dye kinetics may be controlled.

It was also noted to be possible to add to the liquid ammonia any additive having an action on the material or on the dye. It is known that the addition of nucleophilic substances, in particular in the form of ammonium acetate, makes it possible, in the case of certain treatments of textile materials with liquid ammonia, to reduce the treatment times whilst obtaining equivalent results. In the process according to the invention, it is ascertained that such an addition enabled not only the duration of the pre-treatment with liquid ammonia to be reduced, but also, and quite unexpectedly, enabled the duration of the dyeing operation, effected according to the present invention to be reduced by at least 50%. The economic interest in such an addition is immediately appreciated.

The advantages of the process according to the invention are easily seen since it permits considerable savings in time and possibly in dyes in the dyeing operation. Only a small consumption of ammonia is involved, which does not cause any problems of removal. In the case of fibers requiring a treatment with ammonia, it makes it possible to integrate this operation with that of dyeing. Moreover, it generally allows certain operations which are sometimes necessary before dyeing, such as de-oiling and de-sizing, to be eliminated. A good fixing of the material is also noted, this avoiding breaking in the course of dyeing.

The following examples illustrate the invention and the advantages thereof.

Examples 1 to 4 are comparative tests intended clearly to show the advantages of the dyeing process according to the present invention. They are made on a wool fabric weighing about 350 g/m² with a solution of dye C. I ACID BLUE 80 with the following formula:

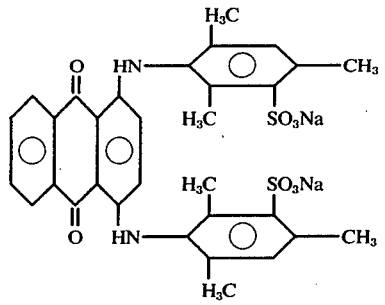

For each example, the same quantity of dye is used.

EXAMPLE 1

A dyeing by exhaustion is carried out under conventional conditions on a sample not treated with liquid ammonia.

The dye bath containing 10% of sodium sulphate is acidified to pH 5.5 by acetic acid then taken to 40° C.

After introduction of the sample, the temperature is taken to 95°–100° C in 30 minutes. The material is maintained at this temperature for 1 hour. After washing and drying, the rate of dye fixed by the fabric is assessed and it is arbitrarily given the index 10.

EXAMPLE 2

A sample not treated with liquid ammonia is dyed under conditions much more rapid than in Example 1.

The dye bath containing 10% of sodium sulphate, acidified to pH 5.5. by acetic acid, is taken to 95° C. The sample is maintained in this bath at constant temperature for about 30 minutes.

After washing and drying, the amount of dye, determined as in Example 1, may be comparatively assessed at 7 or 8. A "rapid" dyeing is therefore not favorable to a good yield.

EXAMPLE 3

A sample is treated with liquid ammonia for 30 minutes; after a partial drying it is dyed under the conditions hereinbelow:

The dye bath, acidified to pH 7 is taken to 95° C. After introduction of the sample, a certain quantity of acetic acid is added so as to bring the pH to 4.5 in 20 minutes. After 10 minutes under these conditions, the sample is washed and dried. The rate of dye may be assessed at from 12 to 14.

This "rapid" dyeing, carried out in a period of time three times shorter than in the case of Example 1, where the sample did not contain ammonia, is, however, noted to enable a dye yield, three times better, to be obtained.

EXAMPLE 4

A sample is treated for 10 to 15 minutes by a liquid ammonia bath in which about 5% by weight of ammonium acetate has been added.

The dyeing, carried out under the same conditions as in Example 3, enables a rate of dye assessed at from 15 to 20 to be obtained.

A comparison between Example 1, illustrating a conventional dyeing process, and Example 4, illustrating the preferred embodiment of the invention, shows the following advantages:

yield of dye multiplied by a factor 2 duration of the actual dyeing operation divided by a factor 3.

The duration of the pre-treatment by the liquid ammonia, especially when a suitable additive is used, is sufficiently short in order not to render the saving in time between conventional dyeing operation and pre-treatment with ammonia followed by a rapid dyeing operation, negligible.

The following Examples illustrate other embodiments of the present invention.

EXAMPLE 5

A strip of 300 g of non-fixed natural wool fabric is wound on a perforated shaft in order to avoid breaks, then placed in a dyeing apparatus of the autoclave type. After the cover is closed, the apparatus is filled with liquid ammonia at −33° C.

After 30 minutes, the liquid ammonia is emptied out, so as to leave in the autoclave only the quantity absorbed by the fabric. The dye bath previously heated to 95° C and containing in aqueous solution 5 $cm^3$ per liter of 98% sulphuric acid and 0.3 g/liter of dye CI ACID GREEN 25 of the following formula:

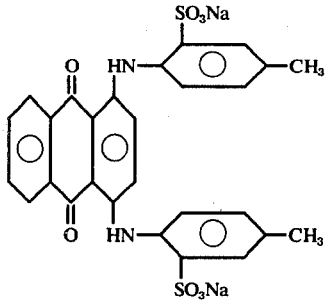

is then introduced.

The temperature is maintained at 95° C for the whole duration of the dyeing.

The pH adjusted to 7 is then progressively lowered to 4.5 in 20 minutes by the addition of acid.

After 10 minutes under these conditions, the fabric is then extracted, rinsed and dried.

A dyeing is obtained in a green coloring having an excellent solidity.

EXAMPLE 6

The treatment is applied under the same conditions as those described in Example 5, on a wool fabric handled in rope form and on wool presented in yarns in sleeve form.

Equivalent results are obtained.

EXAMPLE 7

Operation is carried out in the same manner as in Example 5, but the liquid ammonia contains 5% by weight of ammonium acetate.

In this case, it is sufficient to leave the material in contact with the liquid ammonia for 10 to 15 minutes to obtain equivalent or superior dyeing results.

A shrinkage of the fabric of 8% is observed, slightly more than that obtained in Example 5.

EXAMPLE 8

The pre-treatment with liquid ammonia is effected as in Example 5. Dyeing is effected under the following conditions: the dye bath, acidified to pH 7, is taken to 70° C, the pH is then lowered to 4.5 in 10 minutes, then the temperature is raised to 95° C in 20 minutes. A correct dyeing is obtained equivalent to the result of Example 5.

EXAMPLE 9

The pre-treatment with ammonia is effected as in Example 5. The dyeing is effected under the following conditions: the dye is introduced in the dye bath, maintained at 95° C, only after the pH has lowered to 4.5. This addition is effected progressively in 20 minutes. The sample is maintained for a further 10 minutes in this bath.

A dye is obtained which is comparable to that of Example 5.

EXAMPLE 10

A fabric composed of wool mixed with polyester is treated according to Example 5.

The dye bath contains 3 $cm^3$ per liter of emulsified orthodichlorobenzene (carried for polyester) and 0.2 g per liter of dye CI DISPERSE RED 13 whose formula is as follows:

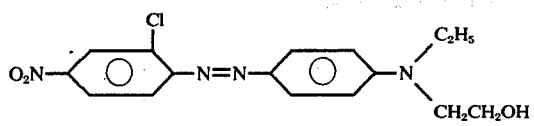

As this type of dye acts only on the polyester, a novelty two-colored product is obtained, whose dyeing presents a good solidity.

EXAMPLE 11

A fabric formed of 80% by weight of acrylic and 20% of wool is treated according to Example 5. 0.3 g per liter of dye CI BASIC BLUE 3 is used, whose formula is as follows:

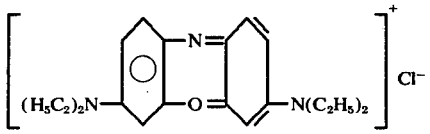

A novelty two-colored product is obtained, as in Example 10.

EXAMPLE 12

A fabric formed of 80% by weight of acrylic and 20% by weight of acidified polyester is dyed (i.e. dyeing with basic dyes). A mixture of the following dyes is used:

0.25 g/liter CI BASIC BLUE 3

0.4 g/liter CI BASIC BLUE 45

A novelty two-colored product is obtained as in Examples 10 and 11.

EXAMPLE 13

A fabric formed of 80% by weight of wool and 20% of polyamide is dyed with 0.5 g/liter of dye CI ACID BLUE 158 of the following formula:

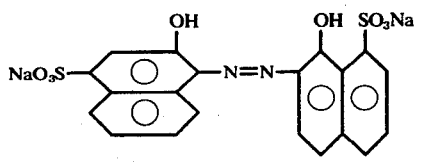

The final pH is brought to 3.5 to obtain a better yield. A dye comparable to Example 5 is obtained.

EXAMPLE 14

The sample and the conditions of treatment are those described in Example 5 with the exception of the dye. 0.3 g/liter of dye CI REACTIVE BLUE 44 is used.

A dye comparable to Example 5 is obtained.

What we claim is:

1. A process of dyeing textile material formed of natural or synthetic polyamides, polyacrylics, polyesters or chlorinated hydrocarbons, wherein the material is first impregnated with liquid ammonia in an impregnation zone, the ammonia in said zone is removed and the material, still impregnated with ammonia, is dyed.

2. A process as claimed in claim 1, wherein the material is subjected to the action of the liquid ammonia containing an additive.

3. A process as claimed in claim 1, wherein the material is maintained under an atmosphere of gaseous ammonia between the treatment with liquid ammonia and the dyeing.

4. A process as claimed in claim 1, wherein the dyeing operation is carried out on the material impregnated with liquid ammonia.

5. A process as claimed in claim 4, wherein the material is subjected to a partial drying between the treatment with liquid ammonia and the dyeing.

6. A process as claimed in claim 4, wherein the material is subjected to a partial rinsing between the treatment with liquid ammonia and the dyeing.

7. A process as claimed in claim 1, wherein the dyeing operation is carried out on the material impregnated with gaseous ammonia.

8. A process as claimed in claim 7, wherein:

the material is subjected to the action of the liquid ammonia, the material is maintained in an atmosphere of gaseous ammonia, the liquid ammonia is removed from the material, the dyeing is effected on the material impregnated with gaseous ammonia.

9. A process as claimed in claim 8, wherein it is carried out in a closed apparatus.

* * * * *